US010458146B2

(12) United States Patent
Masserant

(10) Patent No.: US 10,458,146 B2
(45) Date of Patent: Oct. 29, 2019

(54) WIRE BARRIER

(71) Applicant: Mid-American Gunite, Inc., Newport, MI (US)

(72) Inventor: Keith Masserant, Newport, MI (US)

(73) Assignee: Mid-American Gunite, Inc., Newport, MI (US)

( * ) Notice: Subject to any disclaimer, the term of this patent is extended or adjusted under 35 U.S.C. 154(b) by 591 days.

(21) Appl. No.: 15/026,849

(22) PCT Filed: Oct. 21, 2014

(86) PCT No.: PCT/US2014/061514
§ 371 (c)(1),
(2) Date: Apr. 1, 2016

(87) PCT Pub. No.: WO2015/061277
PCT Pub. Date: Apr. 30, 2015

(65) Prior Publication Data

US 2016/0258183 A1 Sep. 8, 2016

Related U.S. Application Data

(60) Provisional application No. 61/894,619, filed on Oct. 23, 2013.

(51) Int. Cl.
*E04H 17/14* (2006.01)
*E04H 17/02* (2006.01)
(Continued)

(52) U.S. Cl.
CPC ..... *E04H 17/04* (2013.01); *E01F 13/022* (2013.01); *E01F 13/028* (2013.01); *E04H 17/16* (2013.01); *E04H 17/161* (2013.01); *F41H 11/08* (2013.01)

(58) Field of Classification Search
CPC ..... F41H 11/08; E01F 13/022; E01F 13/028; E01F 13/02; E04H 17/04; E04H 17/161;
(Continued)

(56) References Cited

U.S. PATENT DOCUMENTS 873,421 A * 12/1907 Fleming ..... A47F 5/112
211/69.9
1,214,705 A * 2/1917 Neely ..... E04H 17/16
256/31

(Continued)

*Primary Examiner* — Matthew R McMahon
(74) *Attorney, Agent, or Firm* — Quinn IP Law

(57) ABSTRACT

A barrier includes at least one support panel having a first face and a second face and a first bend intermediate the first face and the second face is provided. The support panel is deployable from a folded and packed condition to a free-standing condition, and is re-foldable to a packed condition. In the freestanding condition at least one expandable wire coil is operatively attached to the support panel to form the barrier. The expandable wire coil may be made of barbed wire, razor wire, or concertina wire. The support panel includes a diagonal brace and may include a generally horizontal brace. Retention cable may be strung through the wire coil to retain the wire coil to the support panel. The barrier may be provided as a deployment kit including the barrier materials in a packed condition. A method of deploying the barrier is provided.

23 Claims, 6 Drawing Sheets

(51) Int. Cl.

| | |
|---|---|
| ***E04H 17/04*** | (2006.01) |
| ***F41H 11/08*** | (2006.01) |
| ***E04H 17/16*** | (2006.01) |
| ***E01F 13/02*** | (2006.01) |

(58) Field of Classification Search
CPC ..... E04H 17/163; E04H 17/16; E04H 17/165; G09F 15/0062
USPC ..... 256/2, 26
See application file for complete search history.

(56) References Cited

U.S. PATENT DOCUMENTS 3,322,093 A * 5/1967 Goland ..... B32B 27/00 116/63 P
3,463,455 A * 8/1969 Meckel ..... B21F 25/00 256/8
3,690,620 A * 9/1972 Matson ..... E01F 9/688 248/459
4,136,995 A * 1/1979 Fish ..... E02B 7/005 405/115
4,383,782 A * 5/1983 Pillifant, Jr. ..... E01F 13/02 116/63 P
4,449,316 A * 5/1984 Moorhead ..... A01M 23/08 256/1
4,607,817 A * 8/1986 Aquino ..... A47B 23/044 206/214
4,666,129 A 5/1987 Dobson
5,039,250 A * 8/1991 Janz ..... E01F 7/02 256/12.5
5,347,737 A * 9/1994 Theobald, III ..... G09F 15/0062 248/166
5,530,430 A * 6/1996 Pavlov ..... G08B 13/124 256/2
6,832,752 B2 * 12/2004 Cuzzocrea ..... A01K 3/00 256/25
7,128,308 B2 * 10/2006 Marsh ..... E01F 13/12 256/13.1
7,762,746 B2 * 7/2010 Berenyi ..... E01F 7/025 405/114
7,909,309 B2 * 3/2011 Major ..... F41H 11/08 256/2
8,256,985 B2 * 9/2012 Ashmead ..... E01F 13/02 404/6
8,302,551 B2 * 11/2012 Julnes ..... G09F 1/06 116/63 C
8,596,930 B2 * 12/2013 Woudenberg ..... E02D 17/202 405/302.6
8,720,361 B2 * 5/2014 DiBruno, Sr. ..... B63G 13/00 114/240 D
9,562,335 B1 * 2/2017 Arrington ..... E02B 3/106
9,788,531 B2 * 10/2017 Kokenge ..... A01K 31/06
2003/0099523 A1 5/2003 Pessach et al.
2004/0168389 A1 9/2004 Marsh et al.
2005/0226696 A1 10/2005 Cochrane
2009/0230373 A1 * 9/2009 Helseden ..... E01F 13/022 256/25
2011/0114910 A1 * 5/2011 Stuckel ..... E04H 17/10 256/24

* cited by examiner (Front View)

(Top View)

(Rear View)

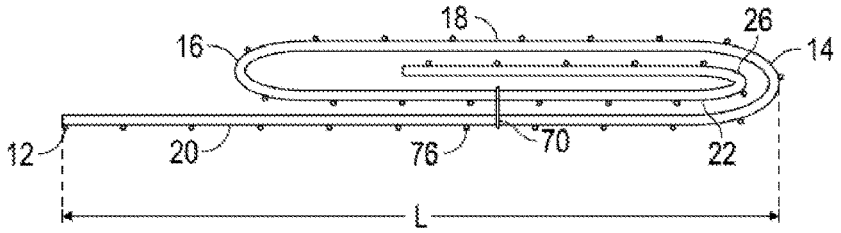
FIG. 9A
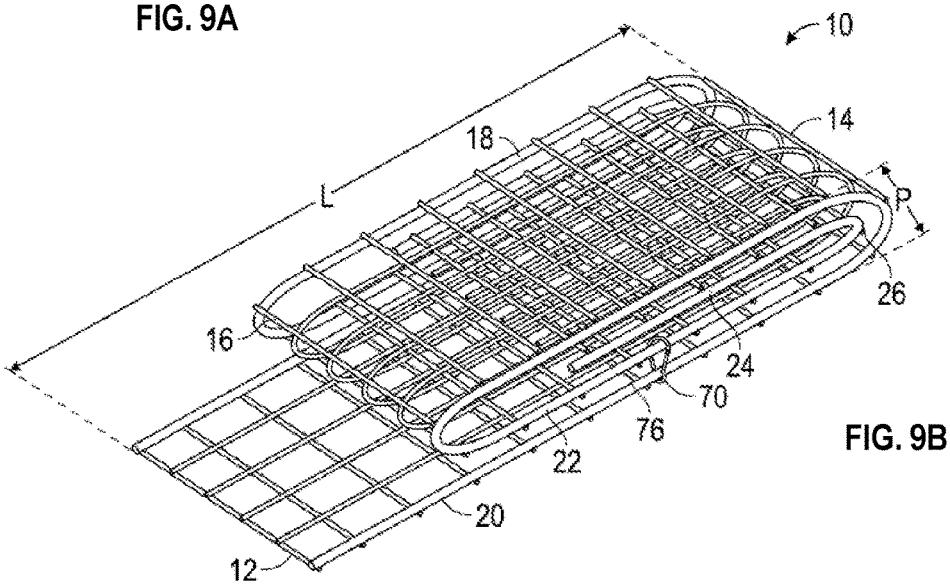
FIG. 9B
FIG. 9C
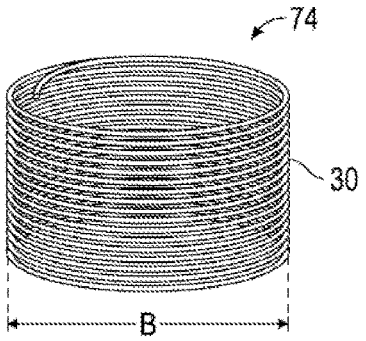
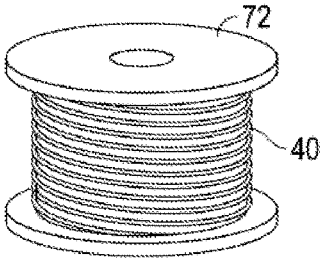
FIG. 9D
FIG. 9

WIRE BARRIER

CROSS REFERENCES TO RELATED APPLICATIONS

This Application claims the benefit of International Patent Application PCT/US2014/061514 filed Oct. 12, 2014 and U.S. Provisional Application 61/894,619, filed Oct. 23, 2013, which is hereby incorporated by reference in its entirety.

TECHNICAL FIELD

The present disclosure relates to an obstacle to impede or disrupt the movement of a person toward a target, and specifically to an obstacle which may be configured as a barrier.

BACKGROUND

One or more obstacles may be strategically placed near or adjacent a target to reduce the potential of access to the target by one or more unauthorized persons, which may be generally referred to as intruders, by impeding or disrupting movement of the intruder or intruders toward the target. The target, which may also be referred to as a protected area, may be an area of property which may contain, for example, facilities, buildings, equipment, materials, and/or people which require protection. The target may be configured for a particular use, for example, as a road, bridge, air strip, etc. or may provide a particular resource, such as water, food, or energy, such that protection of the target from intruders is desirable.

Obstacles such as wire fences may be constructed to obstruct an area adjacent the protected area to impede or disrupt movement of an intruder on foot, by entangling the intruder and/or presenting a barrier to forward movement of the intruder, to impede movement of the intruder toward the target and/or to force the intruder into an upright position, for example, to step or climb over the obstacle thereby increasing visibility of the intruder to surveillance and/or to offensive actions to contain and/or prevent further movement of the intruder toward the target.

Constructing wire fences can be labor and time intensive, and may include stringing razor or barbed wire in a complex and/or multilayer pattern using grids of support posts extending throughout the entire surface of the obstructed area, and attaching the barbed wire to each of the posts in the grid using additional wire wrap and specialized equipment such as wire gauntlet gloves, etc. Installation of the support posts may require digging post holes, anchoring the support posts to the ground surface using brackets or other fastening elements, etc. Razor wire and barbed wire can be difficult to manipulate during installation, presenting an injury risk to installers. The removal of razor wire and barbed wire fences is labor intensive and time consuming, and the removed fence materials may not be readily disposable or reusable.

Constructing upright walls or fences requires installation of a grid of support posts to attach the wall and fencing material. Numerous fence posts must be securely inserted into the ground, which may require digging post holes, and stabilizing and/or anchoring the posts in foundation material such as concrete. Such installations are permanent or semi-permanent, are labor and time intensive to install and remove, and may not be readily portable or reusable.

SUMMARY

A wire barrier including a support panel having a first face and a second face and a first bend intermediate the first face and the second face is provided. The support panel, in one example, is a wire mesh panel. The support panel is deployable from a folded and packed condition to a freestanding condition, where the support panel in the freestanding condition stands self-supporting on a surface such as a ground surface. In the freestanding condition an expandable wire coil is operatively attached to the support panel to form the wire barrier. The expandable wire coil, in a non-limiting example, is made of at least one of barbed wire, razor wire, and/or concertina wire.

In one example, the support panel is a single continuous panel such that the first and second faces are integral to the continuous panel. The support panel includes a first brace arranged such that, with the support panel in the freestanding condition, a second bend is defined intermediate the second face and the first brace and the support panel is freestanding on a ground surface via the second bend line and a first panel end of first face of the support panel. In one example, in the freestanding condition the first face of the support panel is an inclined face, the second face is a generally upright face, and the first brace is a diagonal brace. The support panel may further include a second brace, which is a generally horizontal brace in the freestanding condition.

In the freestanding condition the first face and the second face extend in opposing directions from a vertical plane intersecting the first bend. The first face is an inclined face, and one or more expandable wire coils may be operatively attached to the first face of the support panel, for example, in a tiered arrangement, to form an obstacle on the wire barrier. A retention cable may be extended through the center of one or more of the expanded wire coils and may be operatively attached to the support panel such that the expandable wire coil is disposed between the cable and the support panel, to position and operatively attach the expandable wire coil to the support panel.

The wire barrier may include a plurality of support panels in freestanding condition and positioned at spaced intervals from one another to define a barrier length of the wire barrier, where the expandable wire coil extends the barrier length and is operatively attached to the plurality of support panels. The wire barrier, in a non-limiting example, includes a plurality of expandable wire coils, each expandable wire coil extending the barrier length and operatively attached to the plurality of support panels relative to another of the expandable wire coils to define a plurality of wire coil tiers. A retention cable can be extended through one or more of the expandable wire coils of the plurality of expandable wire coils to operatively attach the respective expandable wire coil to the inclined surfaces of the plurality of support panels, where the retention cable can extend the barrier length or a portion thereof.

A method of deploying the wire barrier is provided herein and includes providing at least one support panel deployable from a packed condition to a freestanding condition, and operatively attaching an expanded wire coil to the first face of the support panel in the freestanding condition. The method may further include extending a retention cable through the expanded wire coil and attaching the retention cable to the support panel to operatively attach the expanded wire coil to the support panel. The wire barrier may be provided as a wire barrier deployment kit including at least one support panel and at least one expandable wire coil, where in a packed condition the deployment kit is provided with the support panel in a folded condition and a wire coil bundle expandable to an expanded condition to form the expanded wire coil. The deployment kit may further include one or more of retention cable, a plurality of fasteners, and hand tools for attachment of the wire coil and/or the retention cable to the support panel(s) to form the wire barrier.

The wire barrier disclosed herein is advantaged by its capability to impede or disrupt movement of an intruder on foot, by entangling the intruder and/or presenting a barrier to forward movement of the intruder, thus impeding movement of the intruder toward a target and/or forcing the intruder into an upright position, for example, to step or climb over the obstacle presented by the wire barrier, thereby increasing visibility of the intruder to surveillance and/or to offensive actions to contain and/or prevent further movement of the intruder toward the target.

The wire barrier disclosed herein is further advantaged by its portability and quick set-up time, being deployable from a packed condition to a freestanding condition without requiring preparation of the surface on which the wire barrier is to be mounted, e.g., without requiring the installation of support posts or other ground support. The support panel is unfoldable from the packed condition and readily arranged to the freestanding condition to receive the expanded wire coil for attachment thereto. The expanded wire coil is transportable in a coil bundle for expansion during attachment to one or more support panels, where a retention cable may be strung through the expanded wire coil during expansion to facilitate quick positioning and attachment of the wire coil to the support panel. The expanded wire coil and/or the retention cable are attached to the support panel using quick release fasteners or fasteners such as crimped sleeves and hog rings, which can be installed with a simple hand held tool. The wire barrier can be dismantled for reuse, at which time the expanded wire coil can be re-compressed into a coil bundle, the retention cable can be re-spooled, and the support panels can be refolded into the packed condition for transport.

The above features and advantages and other features and advantages of the present disclosure will be readily apparent from the following detailed description of the preferred embodiments and best modes for carrying out the present disclosure when taken in connection with the accompanying drawings and appended claims.

and

Figure 1:
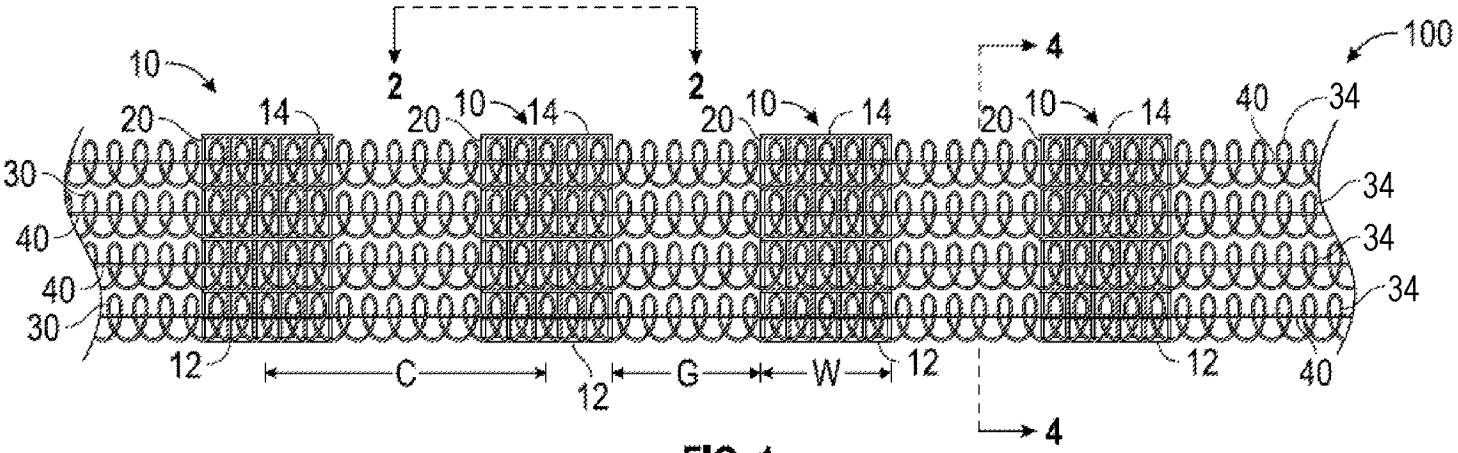
FIG. 1 is a schematic partial front view of a wire barrier extending the length of an obstructed area.
Figure 2:
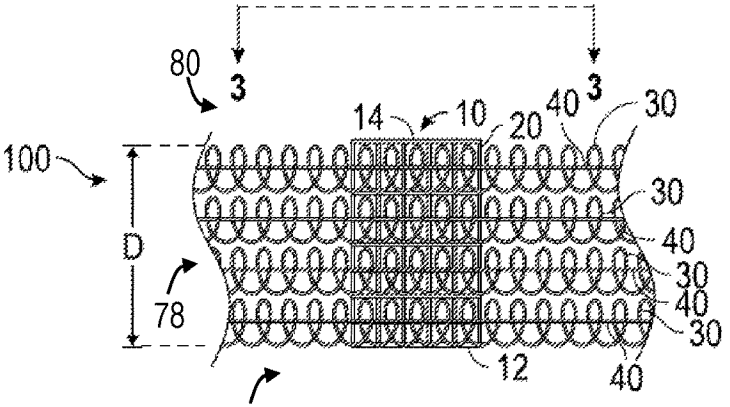
FIG. 2 is a schematic top view section 2-2 of the wire barrier of FIG. 1.

FIG. 9 includes FIGS. 9A-9D which collectively show a schematic illustration of a wire barrier deployment kit;

FIG. 9A is a schematic side view of a support panel in a packed condition;

FIG. 9B is a schematic perspective view of the support panel in a packed condition;

FIG. 9C is a schematic perspective view of a wire coil bundle; and

FIG. 9D is a schematic perspective view of a spool of retention cable.

DETAILED DESCRIPTION

The elements shown in FIGS. 1-9 are not necessarily to scale or proportion. Accordingly, the particular dimensions and applications provided in the drawings presented herein are not to be considered limiting. As used herein, the terms "a," "an," "the," "at least one," and "one or more" are interchangeable and indicate that at least one of an item is present. A plurality of such items may be present unless the context clearly indicates otherwise. All numerical values of parameters, quantities, or conditions in this disclosure, including the appended claims, are to be understood as being modified in all instances by the term "about" or "approximately" whether or not "about" or "approximately" actually appears before the numerical value. "About" and "approximately" indicate that the stated numerical value allows some slight imprecision (e.g., with some approach to exactness in the value; reasonably close to the value; nearly; essentially). If the imprecision provided by "about" or "approximately" is not otherwise understood with this meaning, then "about" and "approximately" as used herein indicate at least variations that may arise from methods of measuring and using such parameters. Further, the terminology "substantially" also refers to a slight imprecision of a condition (e.g., with some approach to exactness of the condition; approximately or reasonably close to the condition; nearly; essentially). In addition, disclosed numerical ranges include disclosure of all values and further divided ranges within the entire range. Each value within a range and the endpoints of a range are all disclosed as separate embodiments. The terms "comprising," "includes," "including," "has," and "having" are inclusive and therefore specify the presence of stated items, but do not preclude the presence of other items. As used in this disclosure, the term "or" includes any and all combinations of one or more of the listed items.

Figure 3:
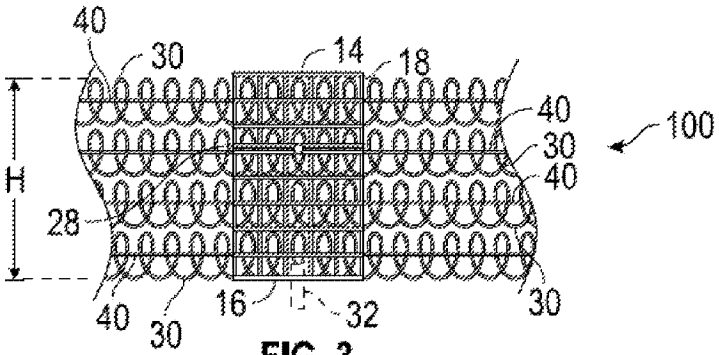
FIG. 3 is a schematic rear view of section 2-2 of the wire barrier of FIG. 1.
Figure 4:
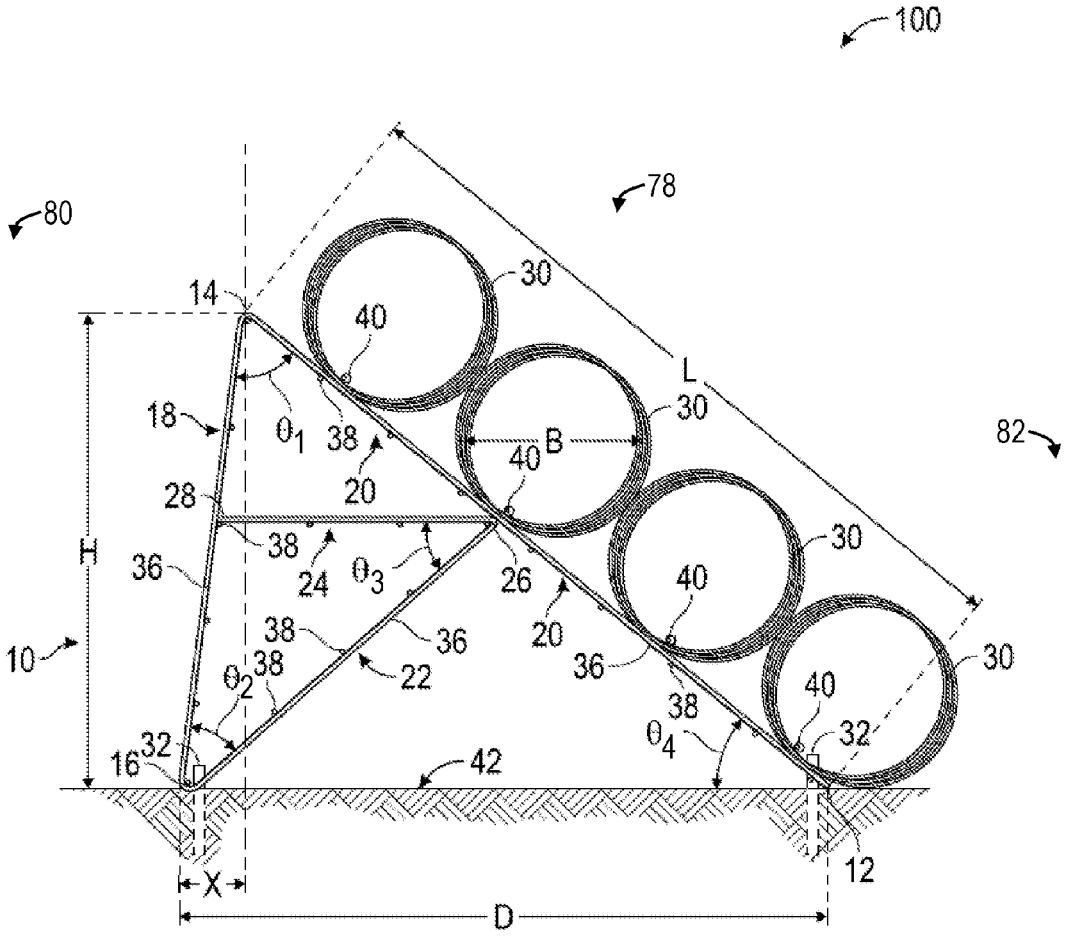
FIG. 4 is a schematic side view of section 4-4 of the wire barrier of FIG. 1 including a support panel in a freestanding condition.

The wire barrier 100 described herein is shown in FIG. 4 in a deployed or installed condition located on a ground surface 42 which is generally horizontal. The terms "vertical," "horizontal," "inclined," and "diagonal" as used herein, are defined relative to the surface 42 upon which the wire barrier 100 is located in the deployed condition. For example, the wire barrier 100 includes a support panel 10 which in the deployed condition is freestanding on the surface 42. The terms "vertical," "horizontal," "inclined," and "diagonal" as used herein to describe elements and features of the support panel 10 are defined relative to the surface upon which the support panel 10 sits in the deployed or freestanding condition. Referring to the drawings wherein like reference numbers represent like components throughout the several figures, there is shown in FIGS. 1-4 a wire barrier generally indicated at 100. The wire barrier 100 includes one or more support panels generally indicated at 10 and one or more expandable wire coils 30 which may be expanded and operatively attached to the support panels 10.

In the example shown in FIGS. 1-4, the wire barrier 100 is shown in a deployed condition, which may also be referred to as an installed condition, and includes a plurality of support panels 10 which are distributed along the length of the wire barrier 100, and further includes a plurality of expandable wire coils 30 attached to the support panels 10 in a tiered arrangement, such that the wire barrier 100 including the support panels 10 and expandable wire coils 30 attached to the support panels 10 covers an obstructed area generally indicated at 78. The obstructed area 78 is located such that the obstructed area 78 lies between a protected area generally indicated at 80 and an intruder area generally indicated at 82, such that the wire barrier 100 is located between the protected and intruder areas 80, 82 and such that the wire barrier 100 must be crossed over from the intruder area 82 by an intruder on foot attempting to access the protected area 80. The protected area 80 may also be referred to herein as the protected side or defended side relative to the wire barrier 100. The intruder area 82 may also be referred to herein as the intruder side, approach side, the enemy side, or the attack side relative to the wire barrier 100.

The wire barrier 100 covers the obstructed area 78 and has an obstructed depth D defined by the depth D of the support panel 10. The support panels 10, which are each freestanding in a deployed or assembled condition, may be spaced at intervals along the length of the wire barrier 100 to establish a wire barrier 100 having a barrier length which is sufficient to protect the protected area 80. The barrier length may be as short as the width W of one support panel 10, or may be of any length defined by the number of support panels 10 deployed and the arrangement of those support panels 10 and the expandable wire coils 30 attached to the support panels 10. The wire barrier 100 may be arranged such that it is continuous and uninterrupted in length, for example, when the wire barrier is constructed as a perimeter barrier to completely enclose a target or protected area. In this example, the beginning and the end of the wire barrier 100 may be connected to each other. The expandable wire coil 30 which may also be referred to as a concertina coil 30, or as a wire coil 30, where the term "wire coil" without additional description is intended to indicate the expandable wire coil 30 expanded to an installed length. A "bundled wire coil" or "wire coil bundle" as those terms are used herein, refers to the expandable wire coil 30 in a non-extended condition where the individual coils of the wire coil 30 are collapsed against each other for storage or transport.

FIG. 1 shows a partial length of a wire barrier 100 which is substantially linear. In the example shown, the support panel 10 has a width W of approximately 36 inches and a depth D of approximately 5.5 feet, and the support panels 10 are spaced at intervals with a center-to-center distance C of approximately 10 feet to provide a gap interval G of approximately 7 feet between the support panels 10. The example shown is non-limiting, and other configurations may be used including using support panels 10 having a width W greater or less than 3 feet and depth D greater or less than 5.5 feet. The center-to-center distance C may be varied, for example, such that the gap interval G is more or less than 7 feet. The gap interval G may be minimized or substantially eliminated by arranging the support panels 10 in a continuous line such that the side of each panel 10 is immediately adjacent to and/or abutting the side of the neighboring panel 10. The center-to-center distance C and gap interval G may be varied, for example, depending on the panel width W, the obstructed length (barrier length) required and/or defined by the length of the protected area 80, and the number of support panels 10 available to construct the barrier, and the method used to attach the wire coils 30 to the support panels 10. In the example shown in FIG. 1, a retention cable 40 is inserted through and extends generally horizontally the expanded length of each tier 34 of wire coil 30, and is used to support the wire coil 30 to prevent sag of the wire coil 30 between the support panels 10 and/or to retain the wire coil 30 to the support panel 10, such that the gap interval G between the support panels 10 may be increased when using the retention cable 40, relative to a wire barrier 100 constructed without the use of a retention cable 40. Further, the retention cable 40 extended through the wire coil 30 presents an additional obstacle to delay or prevent an intruder attempting to access the protected area 80. The center-to-center distance C and gap interval G may be varied along the barrier length between adjacent support panels 10, to stagger the support panels 10 to decrease predictability by an intruder of the position of each support panel 10 relative to another support panel 10, to stagger the support panels 10 as dictated by the terrain on which the wire barrier 100 is constructed, for example, to suspend the wire coils 30 over a water hazard, ditch, tripping hazard, etc., or as required to define the lengthwise shape of the wire barrier 100.

The support panels 10 may be arranged to provide a wire barrier 100 having a lengthwise shape which may be substantially linear, may be arranged along curved lines to provide a curvilinear barrier, may be arranged along angled lines to provide an angled barrier, or may be arranged to provide a lengthwise shape which is a combination of these. The support panels 10 may be arranged to substantially enclose or surround a protected area 80 to provide a perimeter barrier. For example, the support panels 10 may be arranged with the expandable wire coils 30 extended across the support panels 10 to provide a regularly shaped perimeter barrier which is substantially oval or polygon shaped, or the support panels 10 may be distributed at intervals to define an irregularly shaped continuous barrier length including a combination of linear, curvilinear, and/or angled barrier segments 38, 44 arranged as required to enclose the protected area 80. Each support panel 10 is configured to be freestanding in a deployed, e.g., installed or assembled, condition, such that the support panels 10 may be readily movable and easily arranged to define the shape (linear, curvilinear, angled, perimeter, etc.) of wire barrier 100 required to create an obstructed area 78 adjacent the protected area 80, or as indicated by the prevailing conditions and circumstances requiring protection. The support panel 10 is "freestanding," as that term is used and defined herein, such that the support panel 10 in a deployed condition is configured to stand independently on a surface, such as a ground surface 42, without being anchored or otherwise attached to another element such as a support post or fence post, and without being anchored or otherwise attached to the surface 42 upon which the support panel 10 is standing. Optionally, as shown in FIGS. 3 and 4, a retention stake 32 may be installed at the front (intruder side) adjacent a first panel end 12 and/or at the rear (protected side) adjacent a second bend 16 of the support panel 10, for example, to resist movement of the support panel 10 relative to the ground surface 42.

As a result, the installation time and labor required to erect a wire barrier 100 as shown in FIGS. 1-4 is substantially less than that required to erect a conventional concertina wall or wire fence of comparable barrier length, where installation of the conventional concertina wall or wire fence requires installation of a grid of concertina support posts and/or fence posts along the length of the barrier and attachment of the concertina wire and/or fence material to each individual post. Further, because the support panels 10 are freestanding and easily placed in location, and because the wire coils 30 may be expanded between the support panels 10 with no intermediate support posts required, the wire barrier 100 can be erected over rough and/or rocky terrain, swampy areas 78, 80, 82, water hazards, etc. where the irregular characteristics of the terrain can be combined with the wire barrier 100 to provide a combination obstacle. Similarly, the wire barrier 100 can be deployed over tripping obstacles such as rocks, broken concrete, and/or terrain obstacles such as trenches or furrows, etc. to increase the impediments and/or obstacles presented to an intruder attempting to cross the wire barrier 100 to access the protected area 80.

In the example shown in FIGS. 1-4, the wire barrier 100 has a barrier height defined by a panel height H of the support panel 10, and a barrier depth defined by the panel depth D of the support panel 10. The panel height H is of sufficient height and the panel depth D is of sufficient depth to impede and/or prevent an intruder from stepping or jumping over the support panel 10 to access the protected area 80. In a non-limiting example, the panel height H is approximately 4 feet, and the panel depth is approximately 5.5 feet. Other configurations may be used. For example, the panel height H may be increased from a minimum of 30 inches (2.5 feet), where the wire barrier 100 including attached wire coils 30 having a nominal coil diameter B of 18 inches would provide a minimum barrier height of 4 feet, sufficient to impede and/or prevent an intruder from stepping or jumping over the support panel 10. By way of example, the panel height H may range from 2.5 feet to 6 feet, to facilitate portable transport and storage of the support panel 10 in a folded and/or packed condition shown in FIGS. 9A and 9B. For example, the support panel 10, when collapsed from the freestanding condition shown in FIG. 5 and folded into the packed condition shown in FIGS. 9A and 9B, is readily transportable in a vehicle having a cargo area of sufficient size to receive the folded support panel 10, where the folded support panel 10 has a width W and length L in the packed condition. In one example, the support panel 10 has a folded size of approximately 6 feet by 3 feet by 1 foot, such that one or more folded support panels 10 with one or more wire coil bundles 74 are readily transported in a cargo space of a sports utility vehicle, pick-up truck, or similar vehicle, to provide flexibility in the means of transporting the barrier materials during construction and installation, and without requiring a relatively larger cargo vehicle to transport the barrier materials.

Figure 5:
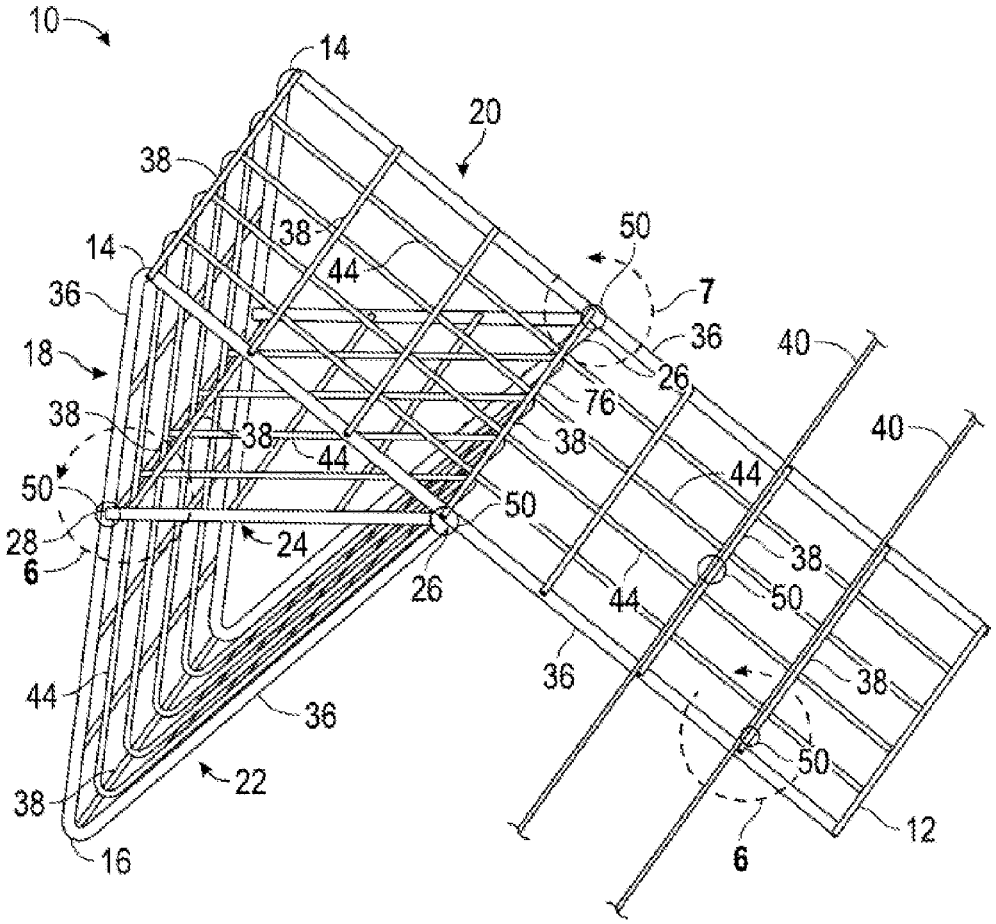
FIG. 5 is a schematic perspective view of the support panel of FIG. 4.
Figure 8:
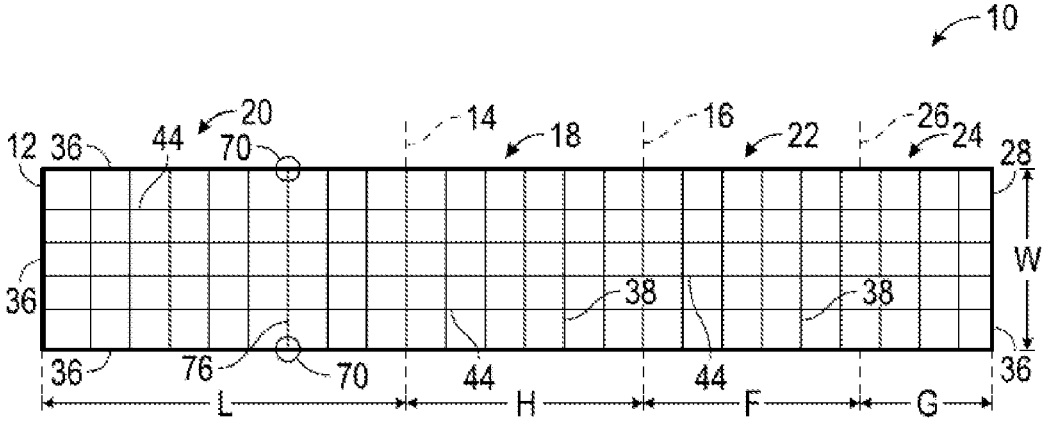
FIG. 8 is a schematic top view of the support panel of FIG. 5 prior to bending.

Referring now to FIGS. 4, 5, and 8, in the non-limiting example shown the support panel 10 is formed by bending a continuous panel 10, such as the panel 10 shown in FIG. 8, to form the support panel 10 which is shown in a deployed condition in FIGS. 4 and 5. The support panel 10 includes first and second panel ends 12, 28 and first, second and third bends 14, 16, 26 defining a first and second face 20, 18 and a first and second brace 22, 24, as described further herein. The support panel 10 in the deployed condition may also be referred to herein as being in a freestanding condition. As shown in FIG. 4, the deployed support panel 10 is freestanding on a ground surface 42 to cover an obstructed area 78 such that the support panel 10 separates a protected area 80 from an intruder area 82.

The continuous panel 10 shown in FIG. 8, which may also be referred to as the unfolded panel 10, may be a wire mesh panel such as a fence panel, which may be of standard size and commercially available from fencing supply manufacturers such that the panel 10 support can be fabricated using standard materials obtainable from commercial sources. In the example shown, the wire mesh panel may be a standard fence panel having a panel width W of approximately 34 to 36 inches and an overall length of approximately 16 feet. In a non-limiting example, the wire mesh panel 10 may be made of galvanized steel wire and/or stainless steel wire, and may include a wire frame 36 to which transverse wire segments 38 and/or longitudinal wire segments 44 are fixedly attached, for example, by welding. The transverse and longitudinal wire segments 38, 44 intersect and/or are attached to each other at each intersection, for example, by a weld, a solder joint, or other attachment, to define the wire mesh. The wire frame 36 and wire segments 38, 44, by way of non-limiting example, are arranged to define a wire mesh having generally rectangular mesh openings. The mesh opening may be uniform or non-uniform across the panel, and may range in size from 2 inches by 4 inches up to 8 inches by 8 inches. The mesh opening may be of sufficient size such that the wire mesh presents a tanglefoot obstacle to an intruder attempting to walk over the support panel 10, as will be described in further detail herein. In one example, the mesh opening size is uniform across the panel and the mesh opening size is one of 4 inches by 6 inches (4×6 mesh) and 4 inches by 8 inches (4×8 mesh) such that the wire mesh may be used as a tanglefoot obstacle. The wire frame 36 and wire segments 38, 44, thus configured, provide numerous locations, including each wire-to-wire intersection and wire-to-frame intersection on the panel 10, at which the wire coils 30 and/or the retaining cable 40 can be attached to the support panel 10 during deployment and installation of the wire barrier 100.

By way of example, the wire frame 36 and wire segments 38, 44 may be made of a galvanized steel wire or stainless steel wire such that the support panel 10 is corrosion resistant and has structural strength to support the attached wire coils 30 in a deployed condition. In a non-limiting example, the wire frame 36 and the wire segments 38, 44 are made of wire having a wire gauge of 8 AWG or less, e.g., having a wire diameter of at least 0.1285 inches. The gauge of the wire frame 36 may be less than the gauge of the wire segments 38, 44, to provide additional strength and stability to the support panel 10 in the freestanding condition. In the example shown, the wire frame 36 is made of wire having a wire gage of 4 AWG or less, e.g., having a wire diameter of at least 0.2043 inches, and the wire segments 38, 44 are made of wire having a wire gauge of 5 AWG or less, e.g., having a wire diameter of at least 0.1819 inches. The wire material may be sufficiently ductile such that the panel 10 is repeatedly bendable from an unfolded panel 10 shown in FIG. 8 to the freestanding configuration shown in FIGS. 4 and 5. By way of example, the wire material may be sufficiently ductile, may be resistant to work hardening, and may have sufficient spring back or memory such that the panel 10 is repeatedly foldable from the freestanding condition shown in FIGS. 4 and 5 to a packed condition shown in FIGS. 9A and 9B, and repeatedly deployable from the packed condition to the freestanding condition. The support panel 10 may be formed such that the first, second and third bends 14, 16, 26 are configured to facilitate spring back of the first and second faces 20, 18 and first and second braces 22, 24 to the deployed condition during unpacking of the packed panel 10 to the deployed condition. In the packed condition the folded panel 10 consumes a generally rectangular space, having a packed length L equal to the length L of the inclined face 20, a packed width W equal to the panel 10 width W, and a packed height P which is substantially less than the deployed height H of the freestanding panel 10. For example, the packed height P may be between 6 and 24 inches, substantially less than the deployed height H of 4 feet, such that the in the folded panel 10 consumes substantially less space than the deployed panel 10, facilitating storage and transport of the support panel 10 in a packed condition. In the example shown, the length L of the inclined face 20 is approximately 6 feet, such that the packing space required to store and/or transport the folded support panel 10 is a substantially rectangular space measuring 6 feet by 3 feet by 6-24 inches.

The support panel 10 includes a first face 20 and a second face 18 which are defined by a first bend 14 intermediate the first and second face 20, 18. The first face 20, which is also referred to herein as the inclined face 20, terminates in a first panel end 12. As shown in FIG. 5, the first panel end 12 may include and/or be immediately adjacent to or defined by a transverse wire segment 38 such that the transverse wire segment 38 reinforces the first panel end 12 in a transverse direction, e.g., across the width W of the panel 10, and is in contact with the ground surface 42 with the support panel 10 in the freestanding condition. In another example shown in FIG. 8, the wire frame 36 extends the perimeter of the continuous panel 10, such that the wire frame 36 defines the first panel end 12 and is in contact with the ground surface 42 with the support panel 10 in the freestanding condition. The wire frame 36 may be made of a thicker wire, e.g., a lower gage wire, than the wire segments 38, 44, such that the wire frame 36 reinforces the first panel end 12 in the transverse direction. The first bend 14 is formed such that the first face 20 is an inclined face 20 defining an incline angle $\theta_4$ between the first face 20 and the ground surface 42 when the support panel 10 is deployed and freestanding, the incline angle $\theta_4$ having a vertex is defined by the first panel end 12.

The support panel 10 in the freestanding condition is configured such that the incline angle $\theta_4$ and the first bend angle $\theta_1$ are acute angles, and the triangle defined by the first and second faces 20, 18 and the ground surface 42 is an acute triangle. The sum of the incline angle $\theta_4$ and the first bend angle $\theta_1$ exceeds 90 degrees, such that in the freestanding condition the first and second faces 20, 18 extend in opposing directions from a vertical plane (shown in dashed lines in FIG. 4) extending through the first bend 14, to stabilize the support panel 10 in the freestanding condition, and such that the second face 18 of the support panel 10 is offset from the vertical plane by an offset distance X shown in FIG. 4. In one example, the offset distance X ranges from 4 to 6 inches. The second face 18 may be referred to herein as the upright face 18. In the non-limiting example shown, the incline angle $\theta_4$ is approximately 40 degrees, and the first bend angle $\theta_1$ is approximately 60 degrees.

The second face 18 extends from the first bend 14 to a second bend 16, where the second bend 16 is intermediate the second face 18 and a first brace 22. The first brace 22 may also be referred to herein as the diagonal brace 22. The support panel 10 in the freestanding condition stands independently on the ground surface 42 such that the first panel end 12 and the second bend 16 are in contact with the ground surface 42. As shown in FIG. 5, the support panel 10 may be constructed such that the second bend 16 includes or is immediately adjacent to a transverse wire segment 38, such that the transverse wire segment 38 reinforces the second bend 16 in the transverse direction, e.g., across the width of the support panel 10, and such that in the freestanding condition the transverse wire segment 38 included in the second bend 16 is in contact with the ground surface 42.

The first brace 22 extends a length F diagonally from the second bend 16 to a third bend 26 and to an attachment interface 76 defined by the inclined face 20 and intermediate the first panel end 12 and the first bend 14, as shown in FIGS. 4 and 5, such that the first brace 22 when attached to the first face 20 at the attachment interface 76 acts as a bracing member or truss element to stabilize and/or strengthen the support panel 10 in the freestanding condition, and to retain the first face 20 in positional relationship to the second face 18 at the first bend angle $\theta_1$. The first brace 22 is operatively attached to the attachment interface 76 of the inclined face 20, for example, using one or more retainers 50, which may include or be configured as one or more of the retainers 50 shown in FIGS. 6A-6D, as a releasable fastener 70 such as the releasable clip shown in FIG. 7, or using any type of retainer 50 suitable for retaining a frame wire 36 and/or wire segments 38, 44 to each other.

The support panel 10 further defines a second brace 24, which may also be referred to herein as a horizontal brace 24, which extends a length G from a third bend 26 which is intermediate the first and second braces 22, 24, to a second panel end 28. The second brace 24 is operatively attached to the second (upright) face 18 intermediate the first and second bends 14, 16 as shown in FIGS. 4 and 5, such that the second brace 24 when attached to the second face 18 acts as a bracing member or truss element to stabilize and strengthen the support panel 10 in the freestanding condition, and to retain the first face 20 in relationship to the second face 18 at the first bend angle $\theta_1$. The third bend 26 is defined by a third bend angle $\theta_3$ which corresponds to the second brace 24 being positioned generally horizontal in the attached position, such that the first and second braces 22, 24 and the portion of the upright face 18 intermediate the second panel end 28 and the second bend 16 define an obtuse triangle, where second and third bend 16, 26 angles $\theta_2$, $\theta_3$, are each acute angles. In one example, the support panel 10 is configured such that the second and third bend 16, 26 angles $\theta_2$, $\theta_3$, are substantially equal. In one example, the second and third bend 16, 26 angles $\theta_2$, $\theta_3$, are each less than 45 degrees. The second brace 24 is operatively attached to the upright face 18, for example, using one or more retainers 50, which may include or be configured as one or more of the retainers 50 shown in FIGS. 6A-6D, as a releasable fastener 70 such as the snap clip shown in FIG. 7, or using any type of retainer 50 suitable for retaining a frame wire 36 and/or wire segments 38, 44 to each other. The second panel end 28 may include or be adjacent to a transverse wire segment 38, as shown in FIGS. 4 and 5, such that the second panel end 28 is reinforced in a transverse direction by the transverse wire segment 38. The transverse wire segment 38 and/or the frame wire 36 of the second panel end 28 may be connected to a transverse wire segment 38 and/or frame wire 36 of the upright face 18 using a retainer 50 or fastener 70, to attach the second brace 24 to the upright face 18.

Referring now to FIG. 8, the support panel 10 may be initially fabricated from the continuous panel 10 by bending the continuous panel 10 at bend lines, shown as dashed lines in FIG. 8, which correspond to the first, second, and third bends 14, 16, 26 of the support panel 10 in the freestanding condition, and to the respective first, second and third bend angles $\theta_1$, $\theta_2$, $\theta_3$. The continuous panel 10 may be bent using any suitable method, which may include pre-bending each of the first, second, and third bends 14, 16, 26 to a larger angle than the finished first, second and third bend angles $\theta_1$, $\theta_2$, $\theta_3$, to partially form the first, second and third bends 14, 16, 26 and define the respective bend lines of each bend, and may further include finish bending the panel 10 to form the first, second and third bends 14, 16, 26 to the respective first, second and third bend angle $\theta_1$, $\theta_2$, $\theta_3$. The support panel 10 may be bent using a standard wire bender such as the type used for bending wire mesh fence panels. For example, the support panel 10 may be fabricated in the field from fence stock cut to the full length of the panel 10, and using any suitable available mandrel, for example, a length of angle iron, which may be positioned at the desired bend line and around which the panel 10 may be bent to form the required bends 14, 16, 26 and bend angles $\theta_1$, $\theta_2$, $\theta_3$. The panel 10 may be bent to retain some spring back at each bend, such that if adjustment of the faces 18, 20 and braces 22, 24 relative to each other is required during deployment, the adjustment is can be made by pulling together the interfaces being attached, rather than having to open the bend angles $\theta_1$, $\theta_2$, $\theta_3$ to position the faces 18, 20 and braces 22, 24 relative to each other, and such that in the freestanding condition the braces 22, 24 are preferably in tension to stabilize the deployed support panel 10.

Referring again to FIGS. 1-4, during deployment, e.g., installation and assembly of the wire barrier 100, the support panels 10 are deployed and positioned at spaced intervals to define the obstructed area 78. The support panels 10 may be deployed from a packed condition to a freestanding condition, as described herein, or may be fabricated in the field from continuous or substantially flat mesh panels 10, as previously described. The deployed support panels 10 are positioned such that the inclined first face 20 is facing the intruder area 82, and the upright second face 18 is facing the protected area 80. Expandable wire coils 30 are expanded and attached to the inclined face 20 of the support panels 10 to form the wire barrier 100. As shown in FIGS. 1-4, multiple wire coils 30 may be attached to each support panel 10 in layers or wire coil tiers 34. Each wire coil tier 34 is operatively attached to the inclined face 20. Optionally, the wire coil tiers 34 may be attached to each other, e.g., each tier 34 may be attached to an adjacent tier 34. The extended wire coil 30 may be directly attached to frame wire 36 and/or the wire segments 38, 44 defining the inclined face 20, or to the wire coil 30 of an adjacent wire coil tier 34 using one or more or a combination of the retainers 50 and fasteners 70 shown in FIGS. 6A-7.

The expandable wire coils 30 may be made of at least one of barbed wire, razor wire, and concertina wire, such that the wire coil 30 in the installed position, e.g., expanded and operatively retained to the support panels 10, presents an entanglement obstacle to an intruder, preventing and/or impeding an intruder from crossing the obstructed area 78 covered by the wire barrier 100, thus preventing and/or delaying access by the intruder to the protected area 80. The wire coil 30 may be made of galvanized steel and/or stainless steel such that the wire coil 30 is corrosion resistant. The wire coil 30 may be of any suitable size and length. By way of example, the wire coil 30 shown in FIGS. 1-4 may have a coil diameter of 18 inches, such that four tiers 34 of wire coil 30 may be layered on and attached to the inclined face 20 of the support panel 10 having a length L of approximately 6 feet in the example shown. In another example, the wire coil 30 may have a coil diameter of 24 inches, such that three tiers 34 of wire coil 30 may be layered on and attached to the inclined face 20 of the support panel 10 to fully cover the inclined face 20 having an approximate length L of 6 feet in the example shown, e.g., to extend from the first panel end 12 of the support panel 10 to the first bend 14. The wire coil 30 may be provided for deployment as a wire coil bundle 74 where the wire coil 30 is characterized by a compressed or bundled length and the wire coil 30 is further characterized by an extended length. Multiple wire coil bundles 74 may be required to extend the wire coil tier 34 the entire barrier length, such that the ends 12, 28 of abutting coils may be attached to each other during installation to provide a continuous length of wire coil 30 extending the barrier length for each wire coil tier 34 installed. The upper-most or top-most tier 34 of wire coil 30 may be attached such that the wire coil 30 extends vertically higher than the support panel 10.

The wire coils 30 are configured such that any person, object or material in contact with the wire coils 30 becomes entangled in and/or is cut or lacerated by the barbed, razor or concertina wire, thus deterring an intruder from crossing the wire barrier 100. The examples of wire coil 30 sizes and types described herein are non-limiting, and wire coils 30 of other sizes and types may be used. The wire coil 30 may be transported to the installation site as a wire coil bundle 74, as shown in FIG. 9C, where the bundled wire coil 30 is compressed such that the wire coil bundle 74 consumes substantially less space relative to an extended wire coil 30. During installation, the wire coil bundle 74 is unbundled, typically by releasing wire tie straps 46, and the wire coil 30 is drawn from the bundle 74 to decompress the closely packed coils by extending the wire coil 30 linearly to increase the linear distance between the individual turns of wire, providing an expanded wire coil 30. Where multiple wire coil bundles 74 are required to provide a continuous length of wire coil 30 extending the barrier length, the respective ends 12, 28 of the adjacent wire coils 30 are attached to each other or otherwise joined to provide a continuous length of wire coil 30 for each wire coil tier 34.

In another example, as shown in FIGS. 1-4, the support panels 10 are deployed and positioned at spaced intervals to define the obstructed area 78 as previously described. A retention cable 40 is extended through the center of the expandable wire coil 30 of each wire coil tier 34 and is attached to the inclined face 20 of the support panels 10 to retain the wire coil tier 34 to the support panel 10. During installation, the retention cable 40 may be drawn through the center of the wire coil 30 from a cable spool 72, for example, of the type shown in FIG. 9D, such that the wire coil 30 is expanded from the wire coil bundle 74 concurrently with extending the retention cable 40 the continuous length of the wire coil tier 34. As shown in FIGS. 1-4, multiple wire coils 30 may be attached to each support panel 10 in layers or wire coil tiers 34, where each wire coil tier 34 is retained to the inclined face 20 by a respective retention cable 40, and where the retention cables 40 are spaced at intervals to each other on the inclined face 20, as shown in FIGS. 1-5, to layer the wire coil tiers 34 across the surface of the inclined face 20. The retention cable 40 is attached to the frame wire 36 and/or the wire segments 38, 44 of the inclined face 20 using one or more or a combination of the retainers 50 and fasteners 70 shown in FIGS. 6A-7, or similar such retainers 50 and fasteners 70, such that the retention cable 40 is retained to the inclined face 20 to compresses the wire coil 30 against the inclined face 20 thereby retaining the wire coil 30 to the inclined face 20 to operatively attach the wire coil 30 to the support panel 10. The retention cable 40 may be a metal cable 40, which may be a multi-strand twist cable 40. In one example, the metal cable 40 may be a galvanized steel cable 40 or a stainless steel cable 40 such that the cable 40 is corrosion resistant. By way of example, the retention cable 40 may have a cross-sectional diameter of 1/16 inch to 5/16 inch. In the example shown, the retention cable 40 is a stainless steel twist cable having a diameter of 5/16 inch.

Figure 6A:
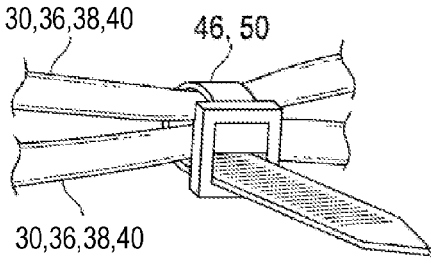
FIGS. 6A-6D are schematic perspective views of example configurations of connectors for connecting the cable and/or the wires of the wire barrier of FIG. 1.
Figure 6B:
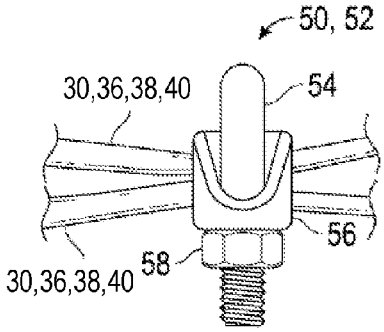

The retention cable 40 may be provided on a spool 72, as shown in FIG. 9D, such that the retention cable 40 can be easily fed from the spool 72 through the center of the wire coil 30 as the wire coil 30 is extended. The spool 72 of cable 40 may be of any length providing a spool 72 of a weight and size which is transportable to the installation site and which can be readily manipulated during deployment of the wire barrier 100. It would be understood that multiple spools 72 of cable 40 may be required to extend the barrier length, where the cable end of the cable 40 of one spool 72 may be spliced to the cable end of the cable 40 of another spool 72 to provide a continuous length of cable 40 extending the barrier length. The cable ends may be spliced together, for example, using a Crosby clamp 52 as shown in FIG. 6B, a crimp sleeve 60 as shown in FIG. 6D, or other means of splicing the cable 40 ends 12, 28 together as would be commonly known. By attaching the retention cable 40, rather than the wire coil 30 to the support panel 10 to retain the wire coil 30 to the support panel 10, less handling and manipulation of the wire coil 30 is required during deployment reducing the risk of injury by the wire coil 30 to persons installing the wire barrier 100. Similarly, risk of injury during dismantling of the wire barrier 100 is reduced, as the wire coils 30 may be separated from the support panel 10 by detaching the retention cable 40 with minimal manipulation or handling of the wire coil 30 required. The wire coil 30 is supported at its vertical height (relative to the ground surface 42) by the generally horizontal retention cable 40, to prevent sagging or displacement of the wire coil tiers 34 relative to each other.

In another example, as shown in FIG. 5, the support panels 10 are deployed and positioned at spaced intervals to define the obstructed area 78 as previously described. The retention cables 40 are extended and attached to the support panel 10 at intervals as shown in FIG. 5, which shows the retention cables 40 attached for the two lower-most wire coil tiers 34. During installation the retention wire may be drawn from a cable spool 72, for example, of the type shown in FIG. 9D. The retention cable 40 is attached to the wire of the wire frame 36 and/or the wire segments 38, 44 of the inclined face 20 using one or more or a combination of the retainers 50 and fasteners 70 shown in FIGS. 6A-7, or similar such retainers 50 and fasteners 70. Each wire coil tier 34 is then attached to a respective retention cable 40 to operatively attach the wire coils 30 to the inclined face 20 of the support panels 10 to form the wire barrier 100. The wire coils 30 are attached to the retention cable 40 using one or more or a combination of the retainers 50 and fasteners 70 shown in FIGS. 6A-7, or similar such retainers 50 and fasteners 70, wire ties, or the like. Attachment of the wire coil tiers 34 to the generally horizontal retention cables 40 prevent sagging or displacement of the wire coil tiers 34 relative to each other.

Figure 7:
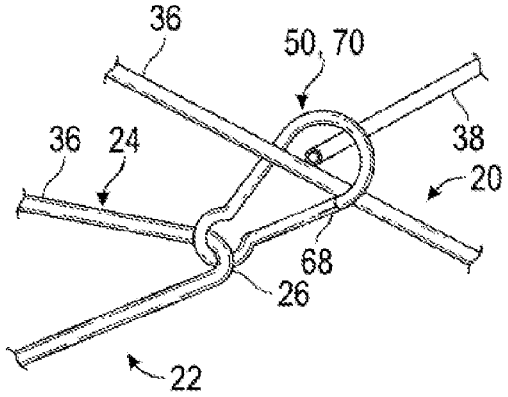
FIG. 7 is a schematic perspective view of a releasable fastener for connecting the cable and/or the wires of wire barrier of FIG. 1.

In one example, the retention cables 40 may be attached to the support panels 10 using releasable fasteners 70, such as the spring link shown in FIG. 7 in a non-limiting example. The wire coil 30 may then be attached to the cable 40 and to the support panel 10 by inserting the wire coil 30 through a spring clasp 68 of a spring link 70 which has already been fastened to the retention cable 40 and support panel 10 to attach the cable 40, panel 10, and wire coil 30 at a shared attachment point using the spring link 70. This method is advantaged by not requiring secondary retainers 50 or fasteners 70 to attach the wire coils 30 to the retention cable 40, and minimized installation time to insert the wire coil 30 through the spring clasp 68 for quick attachment of the wire coil. As described previously, attachment of the wire coil 30 to the retention cable 40, and/or use of the releasable fasteners 70, may reduce the risk of injury by the wire coil 30 to those installing the wire barrier 100 by reducing the amount of handling and manipulation of the wire coil 30 required during deployment.

A combination of fasteners 70 and retainers 50 may be used to attach the retention cable 40 to the support panel 10. For example, a releasable fastener 70 may be used to attach the cable 40 and the wire coil 30 to the support panel at a first attachment point one side of the support panel 10. The cable 40 may be fixedly attached to support panel 10 at another attachment point on the support panel 10 using a retainer 50 such as a Crosby clamp 52 shown in FIG. 6B or a crimping sleeve 60 as shown in FIG. 6D. This assembly method fixedly attaches the retention cable 40 to the support panel 10 such that in the event of the cable 40 being cut, for example, by an intruder, tension in the cable 40 is only lost in the cable segment attached to the support panels 10 adjacent the location of the cut, and the cable 40 remains intact as installed along the remaining length of the wire barrier.

As will be described in additional detail, the type of retainer 50 or fastener 70 used to attach the retention cable 40 to the support panel 10 may be selected based on the intended use of the wire barrier 100, the expected time in use, e.g., permanent versus temporary, and the level of attack resistance desired, e.g., deterrence or intimidation versus entanglement and entrapment. For example, for temporary installations where quick deployment and dismantling is desired, and/or where the wire barrier 100 is primarily a deterrence and/or is under heavy surveillance, releasable fasteners 70 such as the spring link, or similar type releasable and/or reusable fasteners 70, which may also be referred to as quick release fasteners 70, may be preferred for attachment of the retention cable 40 to the support panel 10 and for attachment of the braces 22, 24 to the faces 18, 20 of the support panel 10, such that the wire barrier 100 can be installed and dismantled with minimum labor and time required. In contrast, for permanent installations and/or where the risk of attack on the wire barrier 100 and/or risk of attempts to breach the wire barrier 100 is a consideration, the use of retainers 50 such as the Crosby clamp 52 shown in FIG. 6B or the crimped sleeve 60 shown in FIG. 6D may be preferred, such that the cable 40 is fixedly attached to each support panel 10 along the barrier length. In this configuration, for example, cutting through a segment of cable 40 attached to adjacent support panels 10 would result in the loss of tension of the cable 40 segment only between the adjacent support panels 10, as the remaining length of the retention cable 40 would be fixedly attached to the support panels 10 along the remaining barrier length. Further, the wire coil tiers 34 would remain extended between the support panels 10, supported by their attachment to adjacent support panels 10, such that breaching the wire barrier 100 and/or creating a cut path through the wire barrier 100 would require cutting through both the retention cable 40 and wire coil 30 of each of the multiple wire coil tiers 34.

Referring now to FIGS. 6A-6D, examples of retainers 50 which may be used to attach one of the wire coil 30, the retention cable 40, and the frame wire 36 and/or wire segments 38, 44 of the support panel 10 to at least one other of the wire coil 30, the retention cable 40, and the frame wire 36 and/or wire segments 38, 44 of the support panel 10 are shown. For simplicity of illustration, FIGS. 6A-6D show a first wire element which may be one of the wire coil 30, the retention cable 40, the panel frame wire 36 and the panel wire segments 38, 44 attached to another wire element which may be another of the wire coil 30, the retention cable 40, the panel frame wire 36 and the panel wire segments 38, 44. In a first example shown in FIG. 6A, the wire elements may be attached by a retainer 50 configured as a tie strap 46, also referred to as a cable strap 46, which is looped around the wire elements to be attached. The end of the tie strap 46 is inserted through the locking element of the tie strap 46 and tightened to attach the wire elements. The size of the loop of the tie strap 46 is adjustable during installation, such that the loop size may be varied to compensate for tension or position adjustments between the attached wire elements. No installation tools are required for assembly of the tie strap 46. In another example (not shown), the wire elements may be attached by a retainer 50 configured as a wire wrap, e.g., as a length of wire which is wrappable and/or twistable around the wire elements to be attached.

In another example shown in FIG. 6B, the retainer 50 may be configured as a saddle clip 52, also referred to as a Crosby clamp 52. The Crosby clamp 52 includes a U-bolt 54 and a saddle 56. The saddle 56 includes a recessed surface (not shown) and openings (not shown) to receive the legs of the U-bolt 54 in an installed position. In use, the Crosby clamp 52 is retained to the wire elements as shown in FIG. 6B, where the wire elements are entrapped between the U-portion of the U-bolt 54 and the recessed surface of the saddle 56, and the U-bolt 54 is retained to the saddle 56, for example, by nuts 58 attaching the threaded legs of the U-bolt 54 to the saddle 56. The nuts 58 may be tightened to a predetermined torque to ensure the U-bolt 54 of the saddle clip 52 is fixedly attaching the wire elements.

Figure 6C:
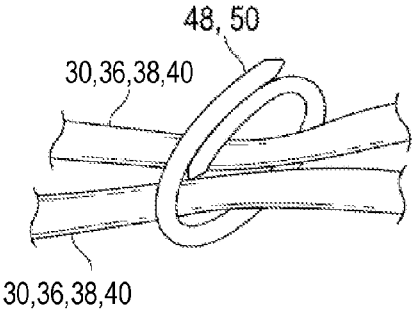
Figure 6D:
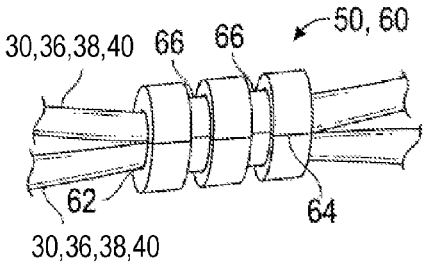

In another example shown in FIG. 6C, a deformable retainer 50 made of metal may be used to attach the wire elements. The metal is corrosion resistant, such as a stainless steel or galvanized steel material. The deformable retainer 50 may be of the type known as a hog ring 48, which is easily applied by deforming the generally C-shaped or open triangle-shaped hog ring 48 around wire elements to be attached using hog ring 48 pliers and/or conventional pliers if hog ring 48 pliers are not available. The size of the opening of the hog ring 48 may be varied by the amount of deformation and/or overlapping of the ends 12, 28 of the hog ring 48.

In another example shown in FIG. 6D, the retainer 50 may be a crimpable sleeve 60 which is readily crimped in the field during installation of the wire barrier 100 to retain or fixedly attach a first wire element to a second wire element. The crimpable sleeve 60 may have a generally cylindrical or oval cross section and define a longitudinal through hole 62 to receive the wire elements. The crimpable sleeve 60 may be a split sleeve 60 including a longitudinal slot 64 to allow the sleeve 60 to be slipped onto the wire elements such that the wire elements to be attached are positioned adjacent each other in the longitudinal through hole 62. The slotted crimpable sleeve 60 is inserted onto the wire elements to be attached, and is crimped at the crimped portions 66 to retain the wire elements in the sleeve 60 and to close the longitudinal slot 64.

In another example shown in FIG. 7, the wire elements may be attached to each other by a releasable fastener 70, which may be reused, and which may be preferred, for example, when quick deployment and/or dismantling of the wire barrier 100 is a consideration. In the example shown, the releasable fastener 70 is configured as a spring link having a spring loaded clasp such that the fastener clasp 68 is easily opened for attaching the wire elements, and otherwise remains closed to attach the wire elements inserted into the fastener 70. The example of a spring link is non-limiting, and other types of quick release and/or reusable fasteners 70 may be used, including, for example, spring snaps, snap hooks, snap clips, toggle snaps, etc.

The examples of retainer 50 configurations shown in FIGS. 6A-7 are non-limiting, and it would be understood that other configurations of clips, clamps, retainers 50 and/or fasteners 70 may be used to attach the wire elements during deployment of the wire barrier 100, for attachment of the faces 18, 20 and braces 22, 24 of the panel 10 supports in the freestanding or packed conditions, and/or for attachment of the retention cables 40 and/or wire coil tiers 34 to the support panel 10.

The wire barrier 100, including the tiers 34 of wire coils 30 attached to the inclined face 20 and the wire mesh of the inclined face 20, may be used as an entanglement barrier to impede or disrupt movement of an intruder on foot attempting to crawl over the wire coil tiers 34 and/or the inclined face 20, by entangling the feet, legs, hands, and/or arms of an intruder in the wire coils 30 and/or in the wire mesh of the inclined face 20, thus impeding movement of the intruder across the obstructed area 78, and/or impeding impede progress of the intruder toward the protected area 80, and/or to force the intruder into an upright position, for example, during attempts by the intruder to disengage a foot tangled in the wire mesh, thereby increasing visibility of the intruder to surveillance and/or increasing the susceptibility of the intruder to offensive actions to contain and/or prevent further movement of the intruder toward the target. The support panel 10 may be configured as a tanglefoot obstacle to impede or disrupt movement of an intruder on foot who attempts to cross the support panel 10, by entangling the foot or feet of the intruder in the openings in the wire mesh of the inclined face 20 of the support panel 10. The support panel 10 may include wire mesh having non-rectangular and/or irregular openings which are large enough to entangle a foot and/or leg, including rectangular, oval, irregular and/or asymmetrical shapes suitable to present a tanglefoot hazard to an intruder on foot to ensnare, trip, or otherwise impede movement of the intruder across the wire barrier 100.

The wire barrier 100 may be strategically placed near or adjacent a protected area 80 including one or more surveillance points (not shown). A surveillance point may be, for example, capable of positioning and/or housing personnel and/or devices to survey the obstructed area 78 including the wire barrier 100, to observe and/or detect intruders attempting to traverse the wire barrier 100, and/or to take defensive or other actions to contain the intruders and/or prevent further progress of the intruders toward the protected area 80, which may include firing on and/or otherwise immobilizing the intruders. The surveillance devices may be automated or non-automated, mechanical, electrical, etc. and may include visual, audio, thermal, and/or other types of surveillance. The surveillance point(s) may be in communication with other detection devices such as cameras, mechanical or laser trip wires, thermal sensing devices, etc. which may be located proximate to and/or within the obstructed area 78 to detect the presence of an intruder in the obstructed area 78 and/or in contact with the wire barrier 100. The other detection devices (not shown) may be integrated into and/or integral to the wire barrier 100. For example, one or more of the retention cables 40 may be instrumented or otherwise configured as a trip wire such that intruder contact with the retention cable 40 at a threshold level may actuate a signal to the surveillance point that an intruder has been detected. Laser lines may be configured such that movement and/or deflection of the wire coils 30 and/or the support panels 10 in a pattern which interrupts the laser line may actuate a signal to the surveillance point indicating the presence of a weighted object on the wire barrier 100 and/or deflecting or otherwise disturbing the nominal or expected position of the wire barrier 100 relative to the laser line.

In addition to the advantages of the wire barrier 100 including the freestanding support panel 10 previously discussed herein, the wire barrier 100 described herein presents advantages related to portability, simple and quick installation for rapid deployment, repairability, and reusability. As described previously, the wire barrier 100 may be transported as a wire barrier deployment kit shown in FIG. 9, where FIG. 9 includes FIGS. 9A-9D. The deployment kit illustrated by FIG. 9 includes one or more support panels 10 in a packed condition as shown in FIGS. 9A and 9B, one or more wire coil bundles 74, one or more spools 72 of retention cable 40, and retainers 50 and/or fasteners 70 (see FIGS. 6A-7), such that the wire barrier deployment kit is readily transportable and quickly deployed in the field to form a wire barrier 100. No support posts or rails need to be staked out or installed, and no post holes or post foundations are required for deployment of the wire barrier deployment kit. Optionally, hand tools (not shown) which may be used to attach retainers 50, such as hog ring clamps or crimpers, may be included in the wire barrier deployment kit. During installation the retention cable 40 can be fed from the spool 72 through the center of the wire coil bundle 74, and drawn off the spool 72 as the wire coil 30 is extended, such that both the extended wire coil 30 and the retention cable 40 are located adjacent the spaced support panels 10 and readily accessible for attachment thereto. Deployment of the folded support panels 10 to a deployed and free standing position requires minimal time and labor, and the first and second bracing elements are quickly attachable to the first and second faces 20, 18 of the support panel 10 using retainers 50 such as crimp sleeves 60 and hog rings 48 which are easy to attach with simple tools, or tie straps 46 which may not require any tools, and which, in the case of releasable fasteners 70 and/or reusable retainers 50 such as spring links and saddle clips 52, may be pre-attached to the support panel 10 to further reduce deployment time in the field.

The wire barrier 100 is advantaged during attack, by requiring time intensive and labor intensive actions by an attacker to create a breach in the multiple tiers 34 of wire coils 30 and multiple retention cables 40 to progress through the barrier. For example, cutting through the tiered wire coils 30 and the retention cable 40 to breach the wire barrier 100 between adjacent support panels 10 requires clearing the wire coils 30 to access the retention cables 40 extending through the wire coils 30. Numerous time-consuming cuts would be required to create any cut path through the multiple wire coil tiers 34 and retention cables 40. Because the wire coils 30 and/or the retention cables 40 are retained to each support panel 10, cutting through or breaching the coils or cables 40 between two adjacent support panels 10 limits the breach to the area between the two adjacent support panels 10 and does not breach the wire barrier 100 beyond (outside of) the two adjacent support panels 10. Thus, the breach is limited to a portion of the wire barrier 100 having a breached length of no more than the gap interval G, and intruder(s) attempting access through the breach are focused and/or channeled into a narrow cut path between the adjacent panels 10, increasing the visibility of the intruder(s) to surveillance and increasing susceptibility of the intruder(s) to targeted offensive actions which may be taken to contain, immobilize, and/or otherwise prevent further movement of the intruder(s) toward the target or into the protected area 80.

Repairs to a breach of the wire barrier 100 may be readily made in the field, using lightweight materials such as replacement wire coil 30, lengths of repair cable 40, retainers 50 such as crimping sleeves 60 or Crosby clamps 52, and minimal tools. For example, the cut ends of the cable 40 may be spliced to reattach the cut ends of the retention cable 40. If the cut ends cannot be spliced together, a length of repair cable 40 may be spliced in using sleeves 60 or Crosby clamps 52. Existing hardware on the wire barrier 100 may be redeployed to repair more critical portions of the wire barrier 100 in the absence of available replacement materials. For example, portions of the wire coil 30 may be removed from one of the tiers 34 of an intact length of the barrier and attached to replacement cable 40 spliced into the breached length of the wire barrier 100, such that the repaired area and the area contributing repair materials may still be protected with multiple tiers 34 of coiled wire. Crosby clamps 52 used in the original installation to retain the retention cable 40 to support panels 10 may be redeployed to splice in replacement cable 40 to repair the breached length of the wire barrier 100.

The wire barrier 100 may be dismantled with negligible to minimal damage to the support panels 10, the wire coils 30, and the retention cables 40, such that the dismantled barrier materials may be rearranged, reconfigured, reinstalled, and/or packaged and stored or transported to a new location and for redeployment. The dismantled barrier materials may be compressed in size prior to transport, for example, by folding of the support panels 10 to the packed condition shown in FIGS. 9A and 9B, re-compressing the expanded wire coil 30 into a coil bundle 74 as shown in FIG. 9C, and re-spooling the retention cable 40 on a cable spool 72 as shown in FIG. 9D. As such, the dismantled and compressed materials forming the wire barrier 100 can be transported as a wire barrier deployment kit characterized by enhanced reusability and portability as compared with, for example, barbed wire or razor wire fences or concertina walls which are affixed to support posts and/or fence posts, where uninstalling the fence or wall requires detachment of the barbed wire, razor wire, concertina wire and/or fence material from a plurality of support and fence posts, then removing the support and fence posts from their installed position in the ground or in foundations prepared for the posts. Uninstalling these fence or wall types of barricades is labor intensive and time consuming, and portions of the materials may not be recoverable or may not be reusable, for example, due to damage incurred during dismantling. The wire barrier deployment kit can include the fasteners and hand tools (if required) to install and/or dismantle the wire barrier 100. The wire barrier 100 can be quickly dismantled in the field by approaching the wire barrier 100 from the protected side to access the retainers 50 and/or fasteners 70 and to detach these. Where reusability and the need for quick dismantling and redeployment is anticipated, retainers 50 and/or fasteners 70 which are easily removed, such as hog ties, tie straps 46, quick release fasteners such as spring links, or a combination of these may be used during installation, to minimize dismantling labor and time during future dismantling. During dismantling, the wire coil 30 and retention cable 40 can be detached from each support panel 10 such that the wire coil 30 can be compressed for re-bundling as the retention cable 40 is re-spooled on the cable spool 72. Knock-down of the freestanding support panels 10 is accomplished by detaching the fasteners 70 retaining the second brace 24 to the first and second faces 20, 18, and folding the first and second braces 22, 24 within the first and second faces 20, 18 into a packed panel 10 as shown in FIGS. 9A and 9B. The packed support panel 10 may be secured in the folded condition by a tie strap 46 or similar retainer 50, or by a releasable fastener 70 such as a spring clip, which may be the same spring clip used during deployment and installation, such that the spring clip is already assembled to the panel 10 and readily accessible to retain the panel 10 in the re-folded condition. By way of example and as shown in FIGS. 5, 7 and 9, a releasable fastener 70, such as a spring clip, may be fastened to the first face 20 of the support panel 10 at the attachment interface 76 such that during deployment the spring clip provides a visual indicator of the location of the attachment interface 76 to assist quick alignment of the third bend 26 for attachment to the first face 20 at the proper location, and assists quick dismantling of the panel 10 by not having to remove or relocate the spring clip from the attachment interface 76 but rather refastening the spring clip to one of the first and second braces 22, 24 to retain the packed support panel 10 in the folded position during transport.

The examples provided herein are not intended to be limiting, and it would be understood that other configurations of the wire barrier 100 described herein may be used. For example, retention cable 40 could be fastened to the first faces 18 of the support panels 10 forming the wire barrier 100, to further reinforce the wire barrier 100 and/or to provide an additional obstacle to an intruder. For example, expandable wire coil could be operatively attached to the first face 18 of the support panel 10, using one or more of the attachment methods described herein.

In another non-limiting example, a wire barrier 100 may include a plurality of support panels 10 and a plurality of retention cables 40, where the retention cables may be vertically spaced relative to each other, as shown in FIG. 5, and retained to the support panels 10 by retainers 50 and/or fasteners 70, to form a wire barrier including the retention cables 40 extending generally horizontally between the support panels 10. Additional retention cables may be attached to the second face of the support panels, to provide two layers of spaced horizontal cables forming the wire barrier. In this configuration, the wire barrier may be formed without wire coil, and deployed, for example, for crowd management, livestock containment, boundary marking, or similar uses where the purpose of the barrier is containment without presenting an injury hazard to that which is being contained.

While the best modes for carrying out the disclosure have been described in detail, those familiar with the art to which this disclosure relates will recognize various alternative designs and embodiments for practicing the disclosure within the scope of the appended claims.

The invention claimed is:

1. A barrier comprising:

a support panel comprising a first face, a second face, a first brace, and a second brace;

wherein the support panel is a single continuous panel such that:

the first and second faces are integral to the continuous panel, the first and second braces are integral to the continuous panel; and the first brace is intermediate the second face and the second brace;

the second brace terminates in a second panel end;

wherein the support panel is deployable to a freestanding condition defining:

a first bend intermediate the first face and the second face, a second bend intermediate the second face and the first brace, and a third bend intermediate the first brace and the second brace;

wherein in the freestanding condition the second panel end is operatively connected to the second face intermediate the first and second bends;

wherein in a packed condition the first and second braces are folded between the first and second faces;

wherein in the packed condition, the second panel end is disconnected from the second face; and wherein the support panel is deployable to the freestanding condition from the packed condition.

2. The barrier of claim 1, wherein the support panel is configured as a wire mesh panel;

wherein the wire mesh panel comprises:

a wire frame; and a plurality of wire segments; and wherein each of the wire segments is fixedly attached to the wire frame to define a plurality of mesh openings, wherein each of the mesh openings is at least four inches by four inches in size such that the plurality of mesh openings define a tanglefoot obstacle configured to at least one of ensnare, trip and impede movement of a person across the wire barrier.

3. The barrier of claim 1, wherein:

the support panel defining a first panel end and the second panel end;

wherein the first face terminates at the first panel end; and the support panel is configured to be freestanding on a ground surface via the first panel end and the second bend.

4. The barrier of claim 1, wherein the first brace is operatively connected to the first face intermediate a first panel end and the first bend.

5. The barrier of claim 1, wherein the third bend is operatively connected to the first face intermediate a first panel end and the first bend.

6. The barrier of claim 1, wherein the second brace is operatively connected to the second face intermediate the first and second bends.

7. The barrier of claim 1, wherein with the support panel in the freestanding condition:

the first face is an inclined face;

the second face is a generally upright face;

the first brace is a diagonal brace; and the second brace is a generally horizontal brace.

8. The barrier of claim 1, wherein with the support panel in the freestanding condition the first face and the second face extend in opposing directions from a vertical plane intersecting the first bend.

9. The barrier of claim 1, further comprising:

the support panel defining a first panel end and the second panel end;

wherein the first face terminates at the first panel end; and an expandable wire coil attached to the first face intermediate the first panel end and the first bend.

10. The barrier of claim 9, wherein the expandable wire coil is made of one of barbed wire and razor wire.

11. The barrier of claim 9, wherein the expandable wire coil is made of concertina wire.

12. The barrier of claim 9, wherein with the support panel in the freestanding condition the first face is an inclined face.

13. The barrier of claim 12, wherein the expandable wire coil is arranged in a plurality of wire coil tiers on the inclined face.

14. The barrier of claim 9, further comprising:

a cable operatively attached to the support panel;

wherein the expandable wire coil is disposed between the cable and the support panel such that the expandable wire coil is operatively attached to the support panel by the cable.

15. The barrier of claim 9, further comprising:

a plurality of support panels;

wherein each support panel of the plurality of support panels in a freestanding condition is positioned at a spaced interval from another support panel of the plurality of support panels such that the plurality of support panels define a barrier length of the barrier;

wherein the expandable wire coil extends the barrier length and is operatively attached to the plurality of support panels.

16. The barrier of claim 15, wherein with the support panel in the freestanding condition:

the first face of each of the plurality of support panels is an inclined face; and the expandable wire coil is operatively attached to the first faces of the plurality of support panels.

17. The barrier of claim 15, further comprising:

a plurality of expandable wire coils; and wherein each of the expandable wire coils extends the barrier length and is operatively attached to the plurality of support panels relative to another of the expandable wire coils to define a plurality of wire coil tiers.

18. The barrier of claim 17, further comprising:

a plurality of cables each extending the barrier length;

wherein each respective cable of the plurality of cables extends through a respective expandable wire coil of the plurality of expandable wire coils to operatively attach the respective expandable wire coil to the inclined surface of the plurality of support panels.

19. The barrier of claim 9, further comprising:

an intruder side of the barrier defined by the first face;

wherein the expandable wire coil is operatively attached to the first face;

a protected side of the barrier defined by the second face;

wherein the expandable wire coil is accessible from the protected side of the barrier such that the expandable wire coil is detachable from the first face via the protected side of the barrier.

20. The barrier of claim 1, wherein the support panel is configured as a wire mesh panel.

21. A barrier comprising:

a support panel comprising a first face, a second face, a first brace, and a second brace;

wherein the support panel is deployable to a freestanding condition defining a first bend intermediate the first face and the second face;

wherein in a packed condition the first and second braces are folded between the first and second faces;

wherein the support panel is deployable to the freestanding condition from the packed condition;

the support panel in the freestanding condition defining a second bend intermediate the second face and the first brace;

the support panel in the freestanding condition defining a third bend intermediate the first and second braces;

an attachment interface defined by the first face;

wherein in the freestanding position the third bend is operatively attached to the first face at the attachment interface;

the support panel comprising a releasable fastener attached to the first face proximate the attachment interface such that:

in the freestanding position the releasable fastener is selectively attachable to the third bend to operatively attach the third bend to the first face intermediate a first panel end and the second bend; and in the packed condition the releasable fastener is selectively attachable to one of the first brace and the second brace to retain the support panel in the packed condition.

22. The barrier of claim 21, wherein the support panel is configured as a wire mesh panel.

23. The barrier of claim 21, wherein the support panel is a single continuous panel such that the first and second faces are integral to the continuous panel.

* * * * *